US006513503B2

(12) United States Patent
Iwamoto et al.

(10) Patent No.: US 6,513,503 B2
(45) Date of Patent: Feb. 4, 2003

(54) FUEL SUPPLY APPARATUS AND FUEL SUPPLY MODULE

(75) Inventors: Takashi Iwamoto, Tokyo (JP); Toshihide Kimisawa, Yokohama (JP); Masaru Sawaguchi, Saitama (JP)

(73) Assignees: Nifco Inc., Yokohama (JP); Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/050,892

(22) Filed: Jan. 18, 2002

(65) Prior Publication Data

US 2002/0112700 A1 Aug. 22, 2002

(30) Foreign Application Priority Data

Jan. 24, 2001 (JP) ..... 2001-016149

(51) Int. Cl.[7] ..... F02M 33/02; F02M 37/04

(52) U.S. Cl. ..... 123/509; 123/514; 137/574

(58) Field of Search ..... 123/509, 514, 123/516, 510, 518; 137/565.17, 565.34, 565.22, 571, 574

(56) References Cited

U.S. PATENT DOCUMENTS 4,051,680 A * 10/1977 Hall ..... 60/689
5,133,324 A * 7/1992 Michiaki ..... 123/514
5,732,684 A * 3/1998 Thompson ..... 123/514
5,941,279 A * 8/1999 Frank et al. ..... 137/574
6,129,074 A * 10/2000 Frank ..... 123/509
6,253,738 B1 * 7/2001 Takahashi et al. ..... 123/509
6,371,153 B1 * 4/2002 Fischerkeller et al. ..... 137/265

FOREIGN PATENT DOCUMENTS

| | | |
|---|---|---|
| JP | 9-268957 | 10/1997 |
| JP | 11-148432 | 6/1999 |
| JP | 2001-3826 | 1/2001 |

* cited by examiner

*Primary Examiner*—Carl S. Miller
(74) *Attorney, Agent, or Firm*—Kanesaka & Takeuchi

(57) ABSTRACT

A fuel supply apparatus includes a main tank and a fuel supply module. The fuel supply module includes a sub tank disposed inside the main tank, a supporting bracket attached to an inside of the sub tank to thereby support a fuel supply pump therein, and a jet pump which includes a jet pump nozzle and sucks a fuel inside the main tank into the sub tank from a bottom thereof by utilizing a generated negative pressure. The supporting bracket includes a jet pump passage, which is connected to the jet pump nozzle in case the sub tank is attached to the supporting bracket. The fuel in the sub tank is supplied to an engine by driving the fuel supply pump, and a part of the fuel is supplied to the jet pump through the jet pump passage to thereby generate the negative pressure therein.

14 Claims, 10 Drawing Sheets

7(a)
53
50
55
56
54
51
52
421
420
422
410
40
431

7(b)
53
421
420
51
55
56
410
40
431

7(c)
53
420
51
55
56
410
40
500
52
431

FUEL SUPPLY APPARATUS AND FUEL SUPPLY MODULE

BACKGROUND OF THE INVENTION AND RELATED ART STATEMENT

The present invention relates to a fuel supply module including a sub tank inside a main tank to supply a fuel from the sub tank to an engine, and a fuel supply apparatus including the fuel supply module.

Conventionally, as a fuel supply module applied to a vehicle, such as an automobile, there is a fuel supply module in which a sub tank is disposed inside a main tank that stores a fuel for the automobile. The sub tank is a fuel storing container which has a lateral cross section sufficiently smaller than that of the main tank. The sub tank includes a fuel supply pump therein, and also includes a jet pump at a position where an inside of the sub tank communicates with an outside thereof. The fuel supply pump is provided for sucking the fuel stored in the sub tank and supplying it into the engine. The jet pump is provided for injecting a part of the fuel, which is supplied to the engine, from a jet pump nozzle to suck the fuel stored inside the main tank into the sub tank by utilizing a negative pressure generated by the jet pump at the time of injecting the fuel.

According to the fuel supply module described above, when the fuel supply pump is driven, the fuel inside the main tank is sucked into the sub tank by the operation of the jet pump, so that the fuel is always stored in the sub tank. Therefore, even if the vehicle is tilted, or even if a level of the fuel stored in the main tank is temporarily lowered due to a centrifugal force applied to the vehicle, the fuel stored in the sub tank can be securely supplied to the engine.

The jet pump described above is generally disposed at a bottom portion of the sub tank to securely suck the fuel into the sub tank even if the fuel inside the main tank is running short. Therefore, when the fuel supply module is assembled, a passage for supplying a part of the fuel, which is discharged from the fuel supply pump, is required to be connected to the jet pump nozzle disposed at the bottom portion of the sub tank before the fuel supply pump is supported at the inside of the sub tank. This operation has to be carried out deep inside of the sub tank, and causes the assembling operation to be extremely cumbersome.

The present invention has been made in view of the foregoing, and an object of the invention is to provide a fuel supply apparatus and a fuel supply module that can facilitate the assembling operation thereof.

Further objects and advantages of the invention will be apparent from the following description of the invention.

SUMMARY OF THE INVENTION

To achieve the above object, the present invention provides a fuel supply module, which comprises a main tank for storing a fuel therein; a sub tank disposed inside the main tank; a fuel supply pump adapted to be driven to supply the fuel inside the sub tank to the engine; a jet pump for sucking the fuel inside the main tank into the sub tank from a bottom of the main tank by utilizing a generated negative pressure; and a supporting bracket attached to an inside of the sub tank so as to support the fuel supply pump at the inside of the sub tank. The fuel in the sub tank is supplied to the engine by driving the fuel supply pump, and a part of the fuel is supplied to the jet pump to generate the negative pressure. The supporting bracket is provided with a jet pump supply passage, which is connected to the jet pump when the supporting bracket is attached to the sub tank, and the jet pump supply passage supplies a part of the fuel discharged from the fuel supply pump to the jet pump.

In case the fuel supply module is provided with pressure regulating means, which relieves some of the fuel discharged from the fuel supply pump to regulate the fuel at a predetermined pressure and supplies the relieved fuel to the jet pump, it is preferable that a holding section for holding the pressure regulating means is disposed in the supporting bracket. Also, positioning means for regulating positions of the sub tank and the supporting bracket may be preferably disposed between the sub tank and the supporting bracket. Further, it is preferable that the jet pump is provided with a sealing member for sealing a space between the jet pump and the jet pump supply passage. In the jet pump supply passage, a second jet pump may be provided.

BRIEF DESCRIPTION OF THE DRAWINGS

FIG. 5(*b*) is a cross sectional view taken along line 5(*b*)—5(*b*) in FIG. 5(*a*);

FIG. 7(*b*) is a cross sectional view taken along line 7(*b*)—7(*b*) in FIG. 6(*b*);

FIG. 7(*c*) is a cross sectional view taken along line 7(*c*)—7(*c*) in FIG. 6(*c*);

FIG. 8(*b*) is a plan view of the sub tank;

FIG. 8(*c*) is a plan view showing a condition that the supporting bracket is attached to the sub tank;

DETAILED DESCRIPTION OF PREFERRED EMBODIMENTS

Figure 2:
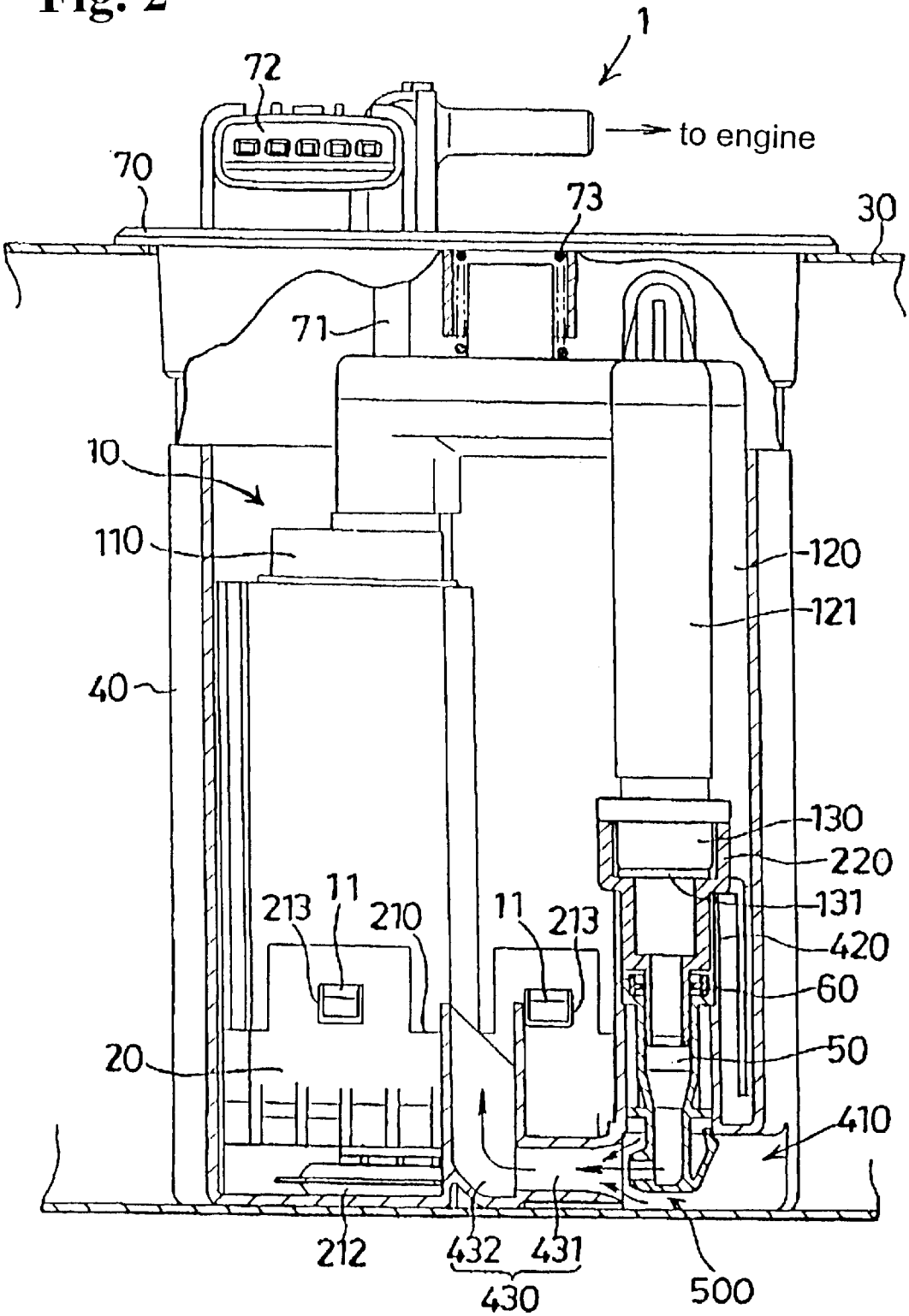
FIG. 2 is a side sectional view of a main part showing a condition that the sub tank is attached to the main tank.

Hereunder, the present invention will be explained with reference to the accompanied drawings showing embodiments of the invention. FIG. 2 shows an embodiment of a fuel supply module according to the present invention. A fuel supply apparatus 1 shown here is provided for supplying a gasoline as a fuel to an engine for an automobile, not shown, and includes a fuel supply module 10.

Figure 3:
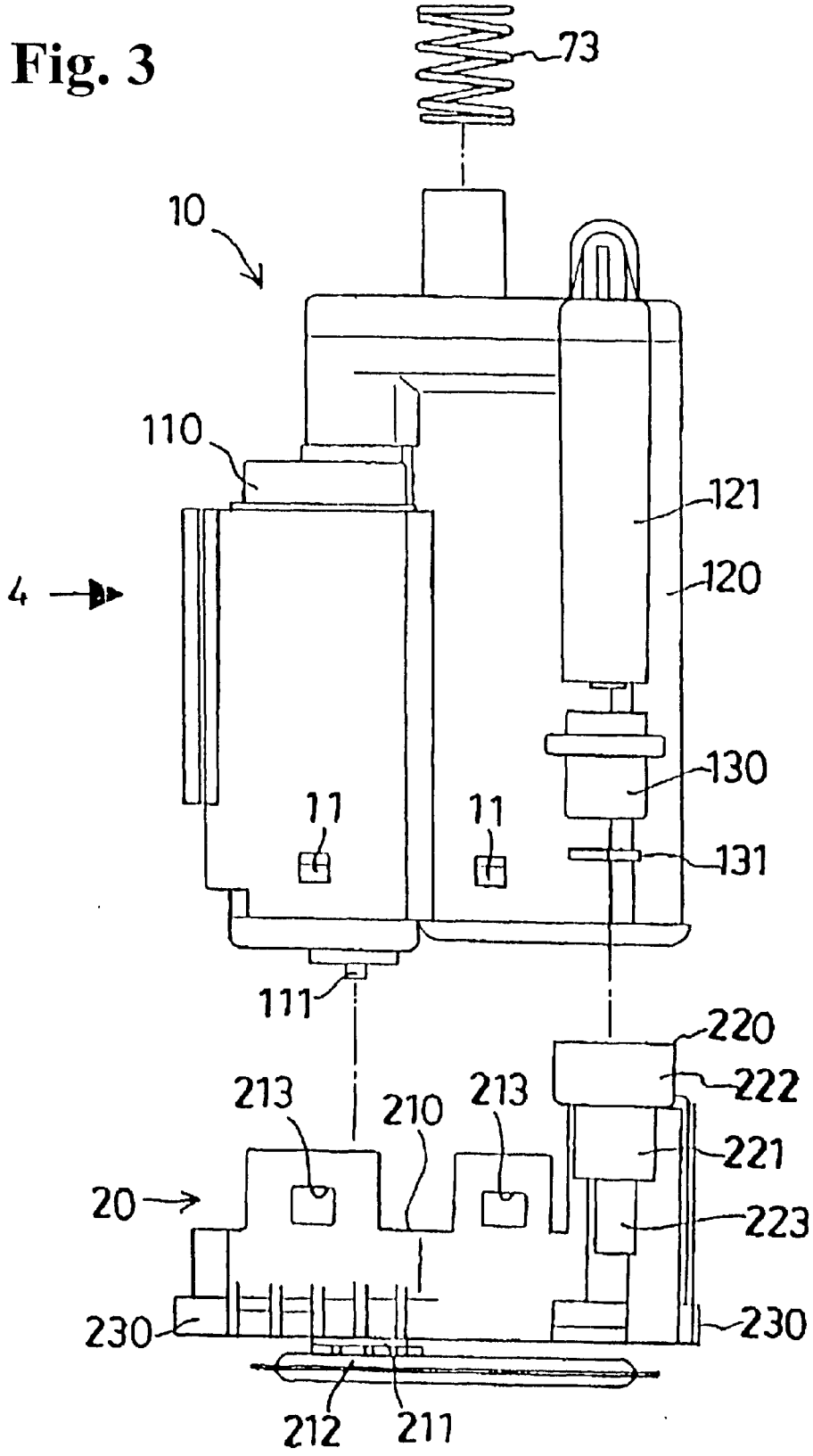
FIG. 3 is an exploded side view showing the supporting bracket to be accommodated in the sub tank, the fuel supply pump, a fuel filter and a pressure regulator.
Figure 4:
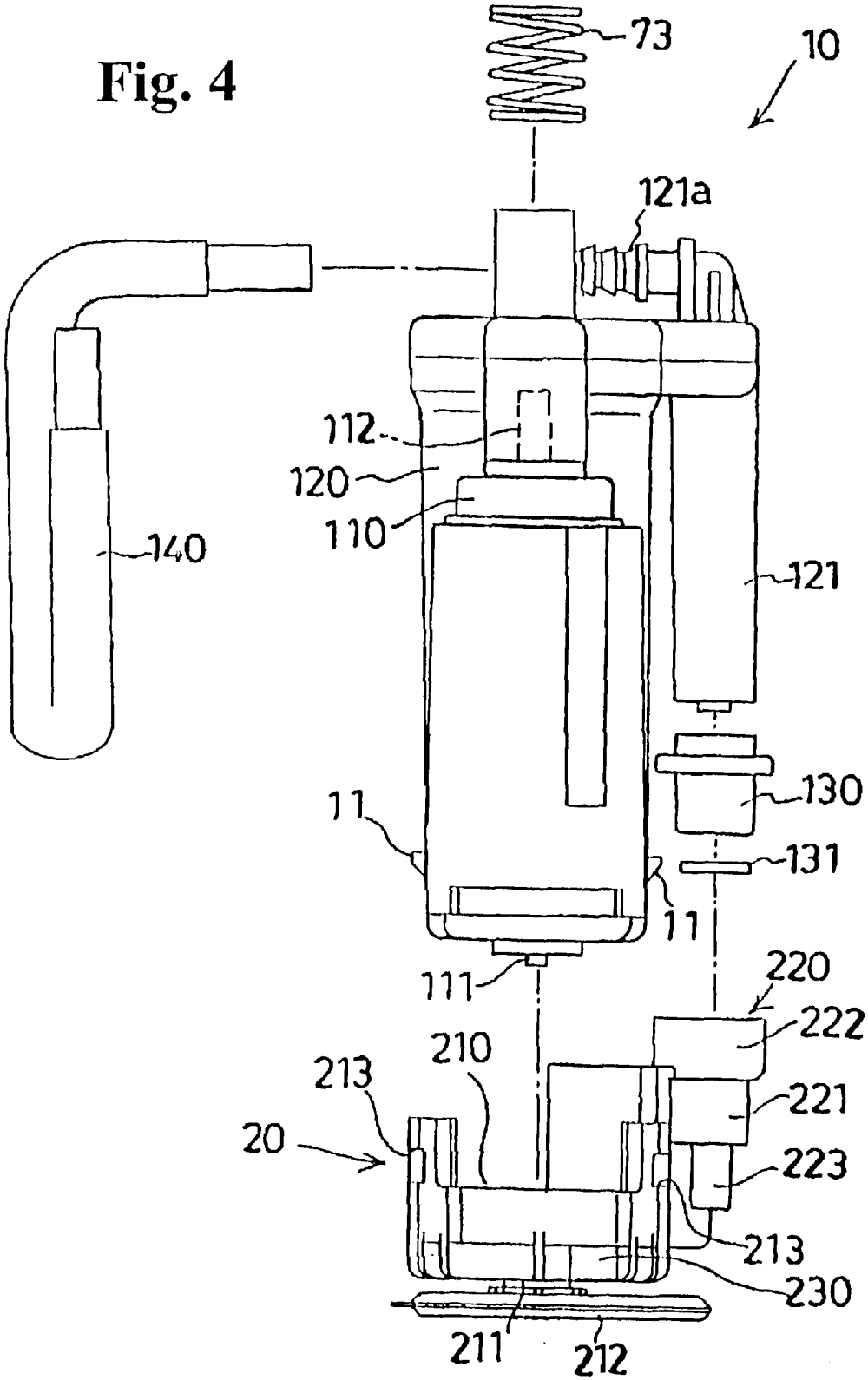
FIG. 4 is a view as seen from an arrow 4 in FIG. 3.

As shown in FIG. 3 and FIG. 4, the fuel supply module 10 includes a fuel supply pump 110; a fuel filter 120; a pressure regulator (pressure regulating means) 130; and a fuel delivery pipe 140. These constituents are made into one unit by a supporting bracket 20 in advance. The fuel supply pump 110 is an electric pump for sequentially discharging a fuel, which is sucked from a suction port 111 at a lower surface thereof, from a discharge port 112 at an upper surface thereof. The fuel filter 120 sequentially filters the fuel discharged from the fuel supply pump 110, and is disposed parallel to the fuel supply pump 110. In the fuel filter 120, a circulation pipe 121 is disposed downwardly from an upper portion of the fuel filter 120 to be externally attached. An inside of the circulation pipe 121 is provided with an ejection passage and a delivery passage 121*a*, which are respectively independent from each other, and the circulation pipe 121 sequentially discharges the fuel filtered by the fuel filter 120 from the ejection passage.

The pressure regulator 130 is connected to a lower end portion of the circulation pipe 121, and adequately relieves the fuel discharged from the ejection passage of the circulation pipe 121, to thereby regulate the pressure of the fuel at a predetermined pressure. The fuel regulated at the predetermined pressure by the pressure regulator 130 is guided to an upper side again through the delivery passage 121*a* of the circulation pipe 121. On the other hand, the fuel relieved by the pressure regulator 130 is discharged to a lower side from a lower surface of the pressure regulator 130. The fuel delivery pipe 140 is a pipe line for delivering the fuel, which is guided to the upper side through the delivery passage 121*a* of the circulation pipe 121, to an adequate position, and the fuel delivery pipe 140 is formed of a synthetic resin, which is elastically deformable, such as polyamide.

Figure 8A:
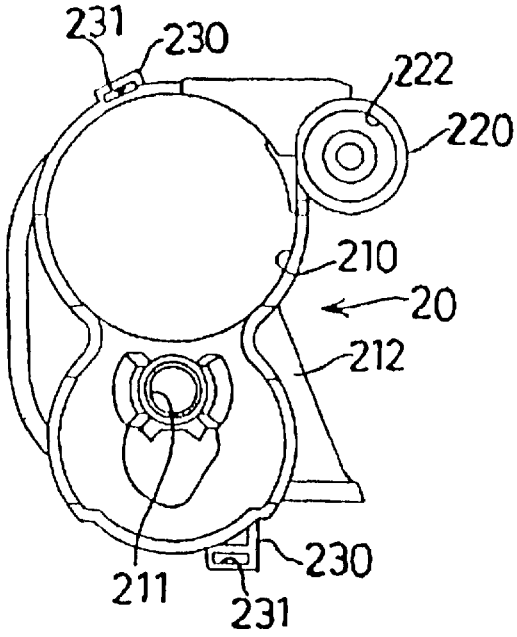
FIG. 8(*a*) is a plan view of the supporting bracket.
Figure 8B:
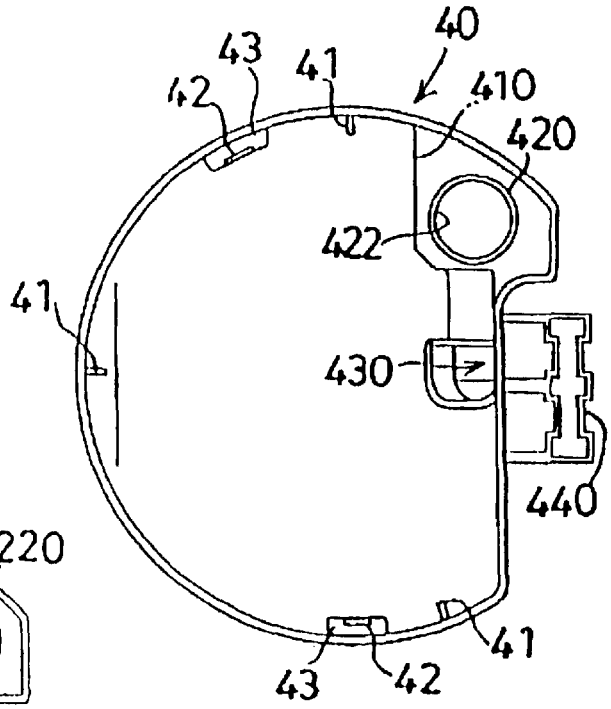
Figure 8C:
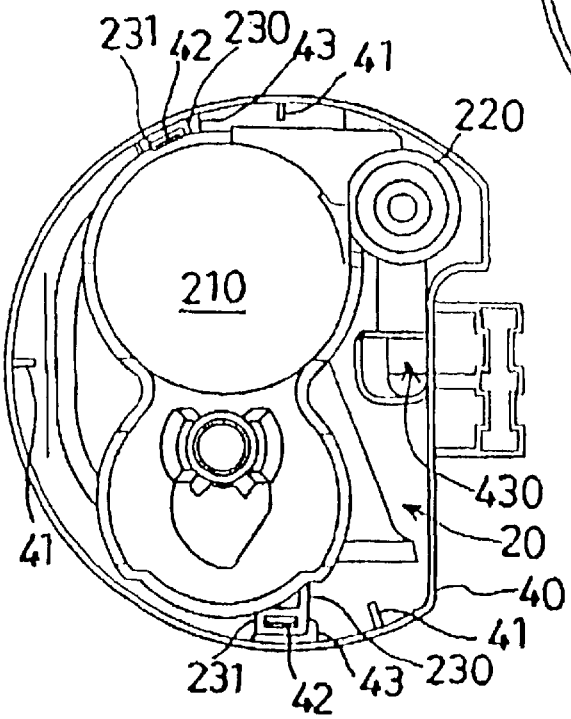

The supporting bracket 20 is formed of a hard synthetic resin with gasoline resistance, such as polyacetal, and includes a module accommodating section 210 arid a jet pump supply passage 220 as shown in FIGS. 3, 4 and 8(*a*).

The module accommodating section 210 is a section to be fitted with lower sides of the fuel supply pump 110 and fuel filter 120, which are arranged parallel to each other. In the module accommodating section 210, a suction passage 211 is bored through a portion opposed to the suction port 111 of the fuel supply pump 110, so that the fuel can be sucked from the lower surface of the supporting bracket 20. Incidentally, numeral reference 212 shown in the figures denotes a simple filter provided for removing a relatively large dust from the fuel sucked through the suction passage 211. Also, numeral reference 213 denotes a notch with which an engagement claw 11 disposed at the fuel supply module 10 is engaged.

The jet pump supply passage 220 is a passage formed at a portion corresponding to the circulation pipe 121 of the fuel filter 120, and is formed integrally with the module accommodating section 210 described above. The jet pump supply passage 220 extends along a vertical direction. The jet pump supply passage 220 includes a regulator accommodating section 222 at an upper end portion of a passage main body 221, and a nozzle inserting section 223 at a lower end portion of the passage main body 221. The regulator accommodating section 222 is a portion which accommodates and holds the pressure regulator 130 described above by interposing a gasket 131 therebetween to thereby receive the fuel relieved from the lower surface of the pressure regulator 130. The nozzle inserting section 223 is a portion for guiding the fuel, which has passed through the passage main body 221, further downwardly, and has a diameter smaller than that of the passage main body 221. As clearly understood from the drawings, the jet pump supply passage 220 is disposed at a position higher than the module accommodating section 210, and the lower end portion of the nozzle inserting section 223 is located at the position higher than the lower surface of the module accommodating section 210.

Also, a plurality of projection inserting sections (positioning means) 230 is disposed at an outer peripheral portion of the supporting bracket 20. Each projection inserting section 230 projects outwardly from the outer peripheral surface of the supporting bracket 20, and has a positioning insertion hole 231 (refer to FIG. 8(*a*)) at each projecting end portion thereof. Each positioning insertion hole 231 has a slit form, and is bored through the projection inserting section 230 along the vertical direction. In the supporting bracket 20 of the present embodiment, the projection inserting sections 230 are formed at two places opposite to each other.

Moreover, the fuel supply module described above includes a sub tank 40 inside a main tank 30 for storing the fuel. The sub tank 40 has a lateral cross section, which is sufficiently smaller than that of the main tank 30 and slightly larger than the fuel supply module 10, and has a form of a cylindrical body with a bottom. As in the supporting bracket 20, the sub tank 40 is formed of a hard synthetic resin with gasoline resistance, such as polyacetal.

Figure 5A:
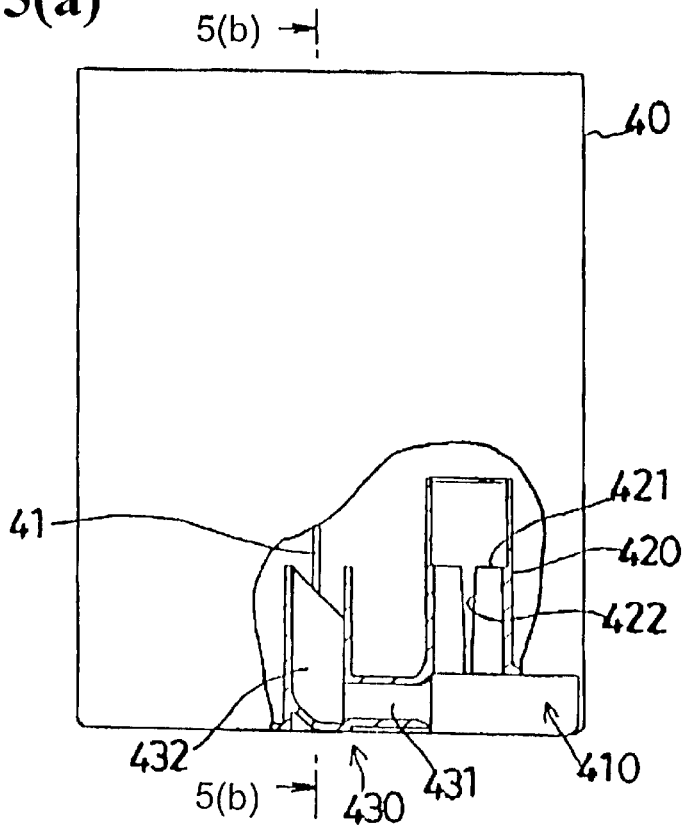
FIG. 5(*a*) is a partly cut side view of the sub tank.
Figure 5B:
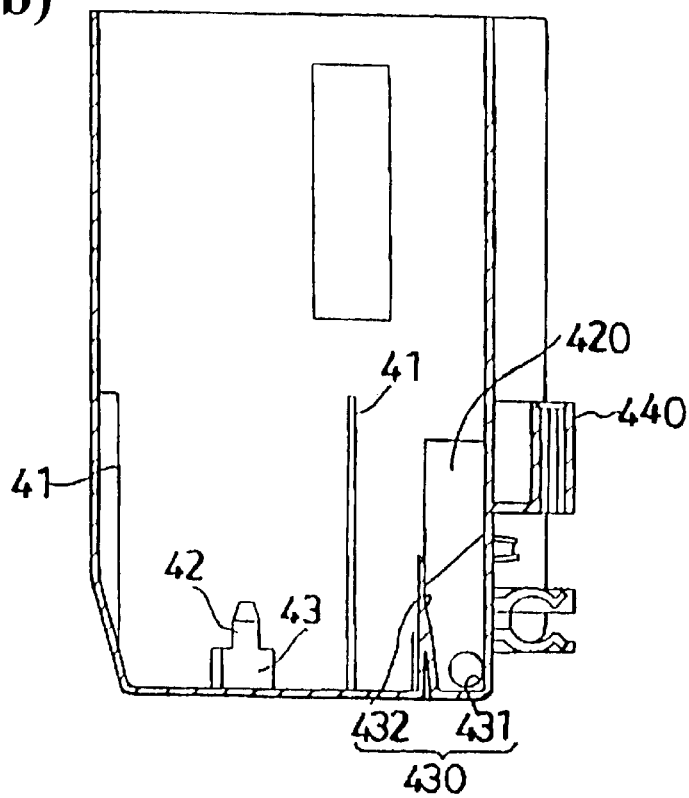

As shown in FIGS. 5(*a*), 5(*b*) and 8(*b*), an inside of the sub tank 40 is provided with three guide ribs 41, and also two positioning projections (positioning means) 42.

The guide ribs 41 are liner projecting portions, which project inwardly from an inner peripheral surface of the sub tank 40 and respectively extend along a vertical direction. The guide ribs 41 are disposed at a lower half portion of the sub tank 40 such that upper end surfaces of the respective guide ribs 41 are at the same height. In the sub tank 40 of the embodiment, three guide ribs 41 described above are disposed at substantially uniform intervals therebetween.

The positioning projections 42 are portions to be inserted into the positioning insertion holes 231 of the supporting bracket 20, and formed such that the widths and thickness thereof are gradually reduced toward the upper side. Each positioning projection 42 projects vertically upwardly from an upper surface of each stand-like section 43 disposed on an inner bottom surface of the sub tank 40. The stand-like section 43 are disposed at portions where the inner bottom surface of the sub tank 40 meets the inner surface thereof such that the stand-like sections 43 are at the same height. Each stand-like section 43 is formed at such a height that a lower surface of the simple filter 212 abuts against the inner bottom surface of the sub tank 40 when the upper surface of each stand-like section 43 abuts against the lower surface of the supporting bracket 20.

Also, a recess portion 410 is formed on an outer front surface of the sub tank 40. As shown in FIGS. 5(*a*), 5(*b*), and FIGS. 8(*a*)–8(*c*), the recess portion 410 is formed at a position corresponding to the jet pump supply passage 220, in case the positioning projections 42 are inserted into the positioning insertion holes 231 of the supporting bracket 20, and the recess portion 410 is formed to open toward a lateral side and lower side at the bottom of the sub tank 40. A nozzle supporting cylinder body (positioning means) 420 and a fuel suction passage 430 are respectively opened to the recess portion 410.

The nozzle supporting cylinder body 420 is a cylindrical portion extending vertically upwardly from a ceiling surface of the recess portion 410, and has an upper end opened to the inside of the sub tank 40. The nozzle supporting cylinder body 420 is formed such that an inner diameter of a lower half portion thereof is slightly smaller than that of an upper half portion, and a step portion 421 is formed at a portion where the lower half portion meets the upper half portion. The upper half portion of the nozzle supporting cylinder body 420 has the inner diameter which allows the passage main body 221 of the jet pump supply passage 220 provided in the supporting bracket 20 to be inserted therein. The lower half portion of the nozzle supporting cylinder body 420 is provided with a single direction defining groove 422 along the vertical direction. As clearly understood from the drawings, the direction defining groove 422 is formed to have a width which is gradually increased toward the upper side. The nozzle supporting cylinder body 420 is formed in such a height that an upper end of the nozzle supporting cylinder body 420 agrees with a boundary between the regulator accommodating section 222 and the passage main body 221 of the jet pump supply passage 220 when the lower surface of the supporting bracket 20 abuts against the upper ia surfaces of the stand-like sections 43.

The fuel suction passage 430 extends horizontally from a side surface of the recess portion 410 toward the lateral direction, and is bent vertically upwardly thereafter. An upper end portion of the fuel suction passage 430 is opened to the inside of the sub tank 40. In the fuel suction passage 430, a lateral cross section of a horizontally extending portion 431 is a circular shape, and an end portion thereof opened to the recess portion 410 has a funnel form in which an inner diameter thereof is gradually increased outwardly. On the other hand, a vertically extending portion 432 of the fuel suction passage 430 has a substantially square tube form, and an inner diameter thereof is sufficiently larger than that of the horizontally extending portion 431.

Incidentally, reference numeral 440 denotes a holding section for holding a gauge assembly of the main tank 30.

Figure 1:
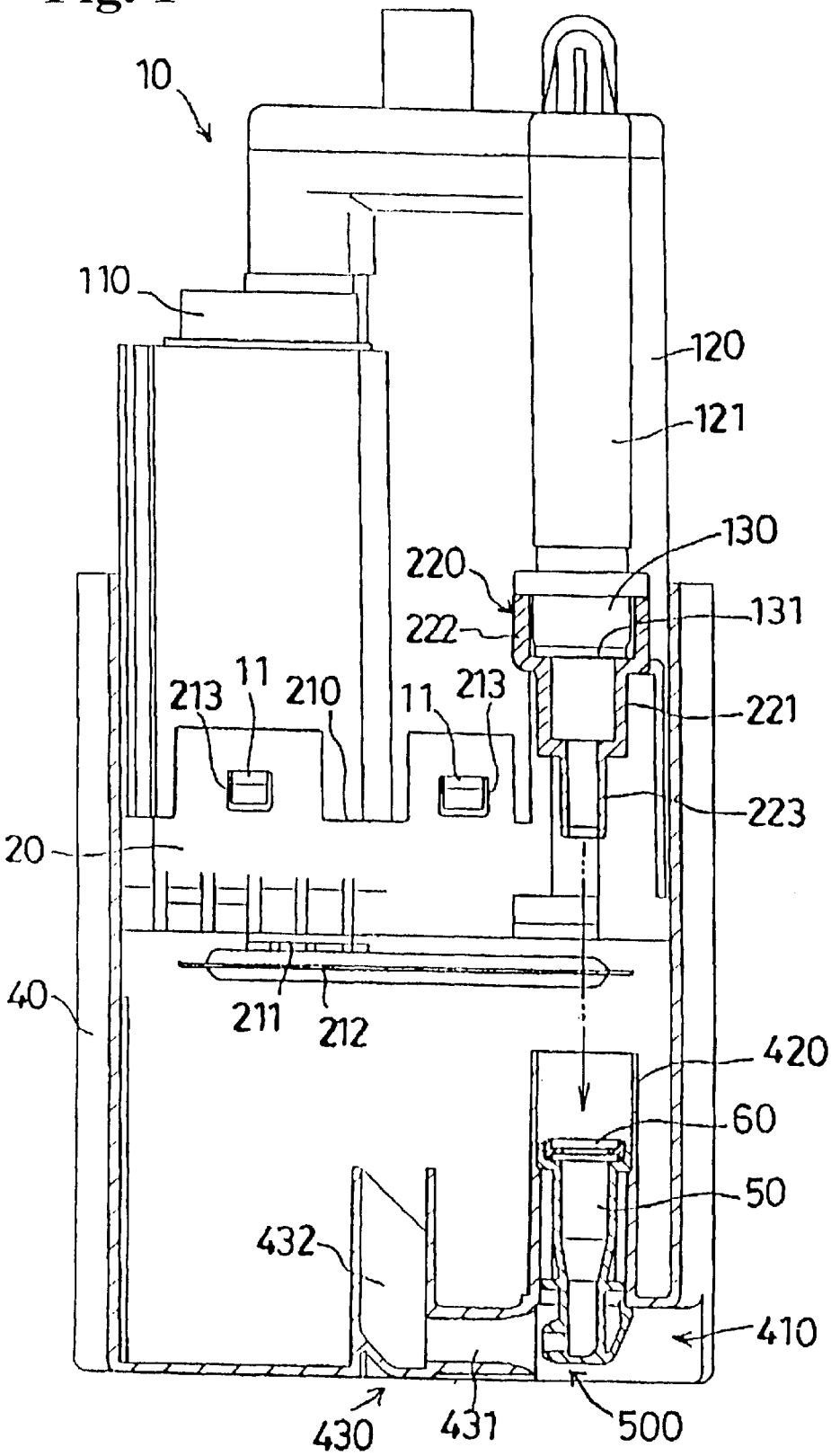
FIG. 1 is a side sectional view of an embodiment of a fuel supply module according to a present invention showing a condition that a fuel supply pump is supported at an inside of a sub tank through a supporting bracket.
Figures 6A, 6B, 6C:
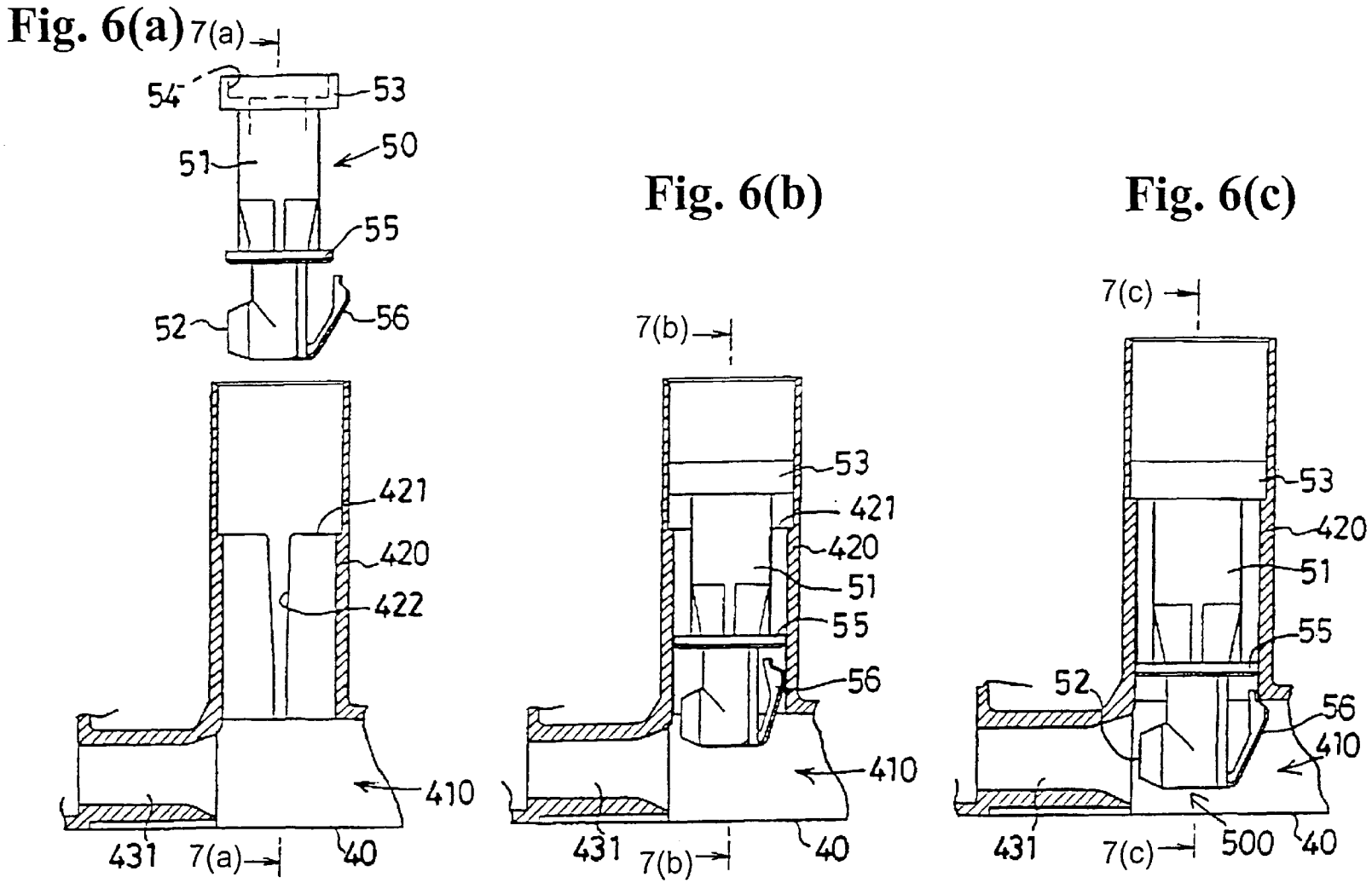
FIGS. 6(*a*) to 6(*c*) are side views of a main part showing attaching conditions of a jet pump nozzle forming the jet pump.
Figure 7A:
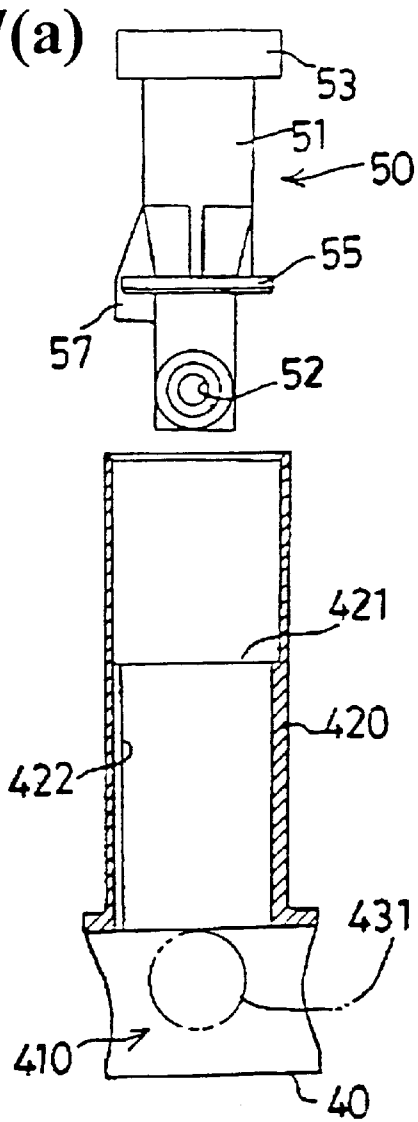
FIG. 7(*a*) is a cross sectional view taken along line 7(*a*)—7(*a*) in FIG. 6(*a*)
Figure 7B:
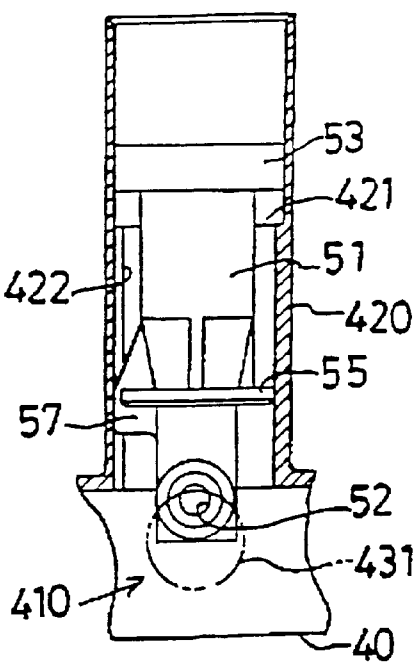
Figure 7C:
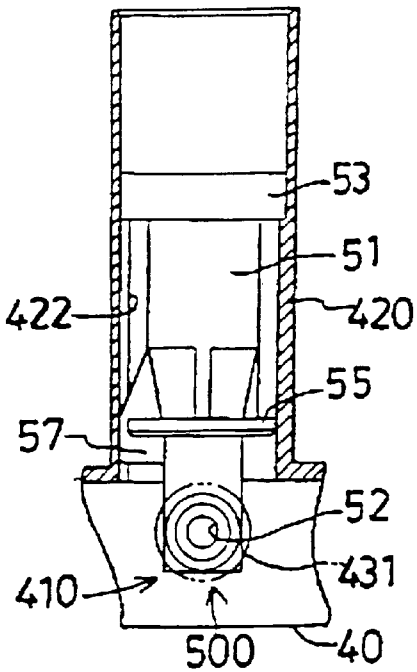

Furthermore, the fuel supply module includes a jet pump nozzle 50 provided inside the nozzle supporting cylinder body 420. As shown in FIGS. 1, 6(*a*)–6(*c*) and FIGS. 7(*a*)–7(*c*), in the jet pump nozzle 50, only one injection port 52 is opened at an peripheral surface of a distal end portion of a nozzle main body 51 in a cylindrical form, and as in the sub tank 40, the jet pump nozzle 50 is formed of a hard synthetic resin with gasoline resistance such as polyacetal. An inner diameter of the nozzle main body 51 is formed in such a size that the nozzle inserting section 223 provided in the supporting bracket 20 can be fitted therewith. A portion forming the injection port 52 of the nozzle main body 51 has an outer diameter, which is slightly smaller than the inner diameter of the horizontally extending portion 431 of the fuel suction passage 430 and is gradually reduced toward the distal end.

The jet pump nozzle 50 is provided with a large positioning flange 53, a seal holding section 54, a small positioning flange 55, an elastic engaging piece 56 and a direction defining rib 57.

The large positioning flange 53 has an outer diameter to be fitted inside the upper half portion of the nozzle supporting cylinder body 420 in the sub tank 40, and is disposed at a base end portion of the nozzle main body 51.

The seal holding section 54 is structured by forming an inner periphery of the large positioning flange 53 to have a large diameter, and holds an annular sealing member 60 therein. The sealing member 60 has an outer diameter slightly larger than the inner diameter of the seal holding section 54, and is held in a slightly bent state in the seal holding section 54. Also, an inner diameter of the sealing member 60 is formed slightly smaller than the outer diameter of the nozzle inserting section 223 of the jet pump supply passage 220.

The small positioning flange 55 is a portion having an outer diameter to be fitted inside the lower half portion of the nozzle supporting cylinder body 420, and is provided at a substantially intermediate portion of the nozzle main body 51.

The elastic engaging piece 56 is a portion extending gradually outwardly from a distal end of a position, which is shifted for 180 degrees with respect to the injection port 52, toward the base end side. The elastic engaging piece 56 is elastically deformable along the radial direction of the nozzle main body 51, and in a free state, an extending end portion of the elastic engaging piece 56 is located outside the outer peripheral surface of the large positioning flange 53.

The direction defining rib 57 is a linear projecting portion which extends along the axial direction of the nozzle main body 51 at the intermediate portion of the nozzle main body 51. The projecting height of the direction defining rib 57 is larger than that of the small positioning flange 55, and substantially the same as that of the large positioning flange 53. The direction defining rib 57 is provided at such a position that the direction defining rib 57 agrees with the direction defining groove 422 of the nozzle supporting cylinder body 420, in case the axial center of the nozzle main body 51 is positioned to accord with the axial center of the nozzle supporting cylinder body 420 while the central axis of the injection port 52 is positioned to accord with a vertical plane including the axial center of the fuel suction passage 430.

As shown in FIGS. 6(*a*) and 7(*a*), the jet pump nozzle 50 having the above structure is accommodated and held in the nozzle supporting cylinder body 420 by inserting the direction defining rib 57, which is positioned on an extension from the direction defining groove 422, from the inside of the sub tank 40 into the nozzle supporting cylinder body 420. In this case, as shown in FIGS. 6(*b*) and 7(*b*), the elastic engaging piece 56 of the jet pump nozzle 50 is elastically deformed adequately inwardly during the insertion thereof into the nozzle supporting cylinder body 420, to thereby allow the insertion of the jet pump nozzle 50 into the nozzle supporting cylinder body 420. Thereafter, as shown in FIGS. 6(*c*) and (7), in case the large positioning flange 53 abuts against the step portion 421, the elastic engaging piece 56 is expanded in the direction toward the outside of the diameter by the elastic restoring force, and an extending end portion of the elastic engaging piece 56 engages the opening portion of the nozzle supporting cylinder body 420. Therefore, the jet pump nozzle 50 is prevented from inadvertently disengaging from the nozzle supporting cylinder body 420.

In this condition, the injection port 52 of the nozzle main body 51 closely faces the opening of the fuel suction passage 430 outside the sub tank 40, and the axial centers of the injection port 52 and the opening of the fuel suction passage 430 agree with each other, so that a jet pump 500 is formed between the nozzle supporting cylinder body 420 and the fuel suction passage 430. In this jet pump 500, the distal end portion of the jet pump nozzle 50 exposed outside the sub tank 40 is located inside the recess portion 410 provided at the sub tank 40. Therefore, in case the sub tank 40 is handled after the jet pump 500 is formed, the jet pump nozzle 50 is prevented from contacting the other members. Accordingly, there is no possibility of giving the impact and damages to the jet pump nozzle 50.

Incidentally, also in the state shown in FIGS. 6(*c*) and 7(*c*), if the jet pump nozzle 50 is pressed toward the inside of the sub tank 40 while the elastic engaging piece 56 is being bent inwardly, the jet pump nozzle 50 can be detached from the nozzle supporting cylinder body 420.

In case of assembling the fuel supply module structured as described above, the fuel supply module 10 is formed in one unit in advance through the supporting bracket 20. in this case, since operations of respectively connecting the fuel supply pump 110, the fuel filter 120, the pressure regulator 130 and the fuel delivery pipe 140, all of which form the fuel supply module 10, with each other, and operations of attaching these members to the supporting bracket 20 can be conducted outside the sub tank 40, these operations can be conducted extremely easily.

Next, as shown in FIG. 1, in the condition that the jet pump supply passage 220 of the supporting bracket 20 is positioned to agree with the nozzle supporting cylinder body 420, the fuel supply module 10 formed in one unit is inserted into the sub tank 40.

In this case, firstly, the nozzle inserting section 223 of the jet pump supply passage 220 provided in the supporting bracket 20 is inserted into the nozzle supporting cylinder body 420, and secondly, the passage main body 221 having the diameter larger than that of the nozzle inserting section 223 is inserted into the nozzle supporting cylinder body 420. Therefore, by the cooperation of these members, the supporting bracket 20 is guided inside the sub tank 40, and the respective positioning projections 42 can be easily inserted into the positioning insertion holes 231 of the supporting bracket 20.

When the positioning projections 42 are respectively inserted into the positioning insertion holes 231 of the supporting bracket 20 so that the lower surface of the supporting bracket 20 abuts against the upper surfaces of the stand-like sections 43, the nozzle inserting section 223 of the jet pump supply passage 220 is fitted with the inside of the jet pump nozzle 50. At the same time, the sealing member 60 seals between the nozzle inserting section 223 and the jet pump nozzle 50, and the jet pump supply passage 220 and the jet pump nozzle 50 are connected to each other.

Then, the fuel delivery pipe 140 is connected to a supply section 71 of a flange member 70, and a lead wire, not shown, of the fuel supply pump 110 is connected to a connector 72 of the flange member 70. Further, in a condition that a coil spring 73 is interposed between the fuel supply module 10 and the flange member 70, an upper end opening of the sub tank 40 is closed by the flange member 70.

Finally, the sub tank 40 closed by the flange member 70 is disposed inside the main tank 30 in the condition that the bottom surface of the sub tank 40 abuts against the inner bottom surface of the main tank 30. When the driving signal is supplied to the fuel supply pump 110 via the connector 72 of the flange member 70 from this condition, by driving the fuel supply pump 110, the fuel inside the sub tank 40 is supplied to the engine via the fuel filter 120, the pressure regulator 130, the fuel delivery pipe 140 and the supply section 71 of the flange member 70. In this case, the fuel supplied to the engine is regulated at the predetermined pressure by the pressure regulator 130.

On the other hand, the fuel relieved by the pressure regulator 130 is supplied to the jet pump nozzle 50 through the jet pump supply passage 220 provided in the supporting bracket 20, and ejected from the injection port 52. Once the fuel is ejected from the jet pump nozzle 50, the negative pressure occurs at the time when the ejected fuel passes through the fuel suction passage 430. Therefore, the fuel stored in the main tank 30 is sucked together with the fuel, which is ejected from the jet pump nozzle 50, from the periphery of the jet pump nozzle 50 into the sub tank 40. Furthermore, since the fuel suction passage 430 is the passage extending vertically upwardly inside the sub tank 40, even in the condition that the fuel is not ejected from the jet pump nozzle 50, there is no such an incidence that the fuel stored in the sub tank 40 reversibly flows to the main tank 30 through the fuel suction passage 430. As a result, the fuel is always stored in the sub tank 40, and even if a body of the automobile is tilted, or even if the level of the fuel stored in the main tank 30 is temporarily lowered due to the centrifugal force applied to the body, the fuel can be securely supplied to the engine.

As explained above, according to the fuel supply module of the invention, the fuel supply module 10 is made into one unit in advance through the supporting bracket 20 provided with the jet pump supply passage 220, so that a fuel supply system extending from the fuel supply pump 110 to the jet pump nozzle 50 can be assembled outside the sub tank 40. At the same time, if the fuel supply module 10 made into the unit is accommodated and held in the sub tank 40, the jet pump supply passage 220 and the jet pump nozzle 50 can be connected to each other. Therefore, the operations of assembling the fuel supply module can be carried out extremely easily.

Figure 9:
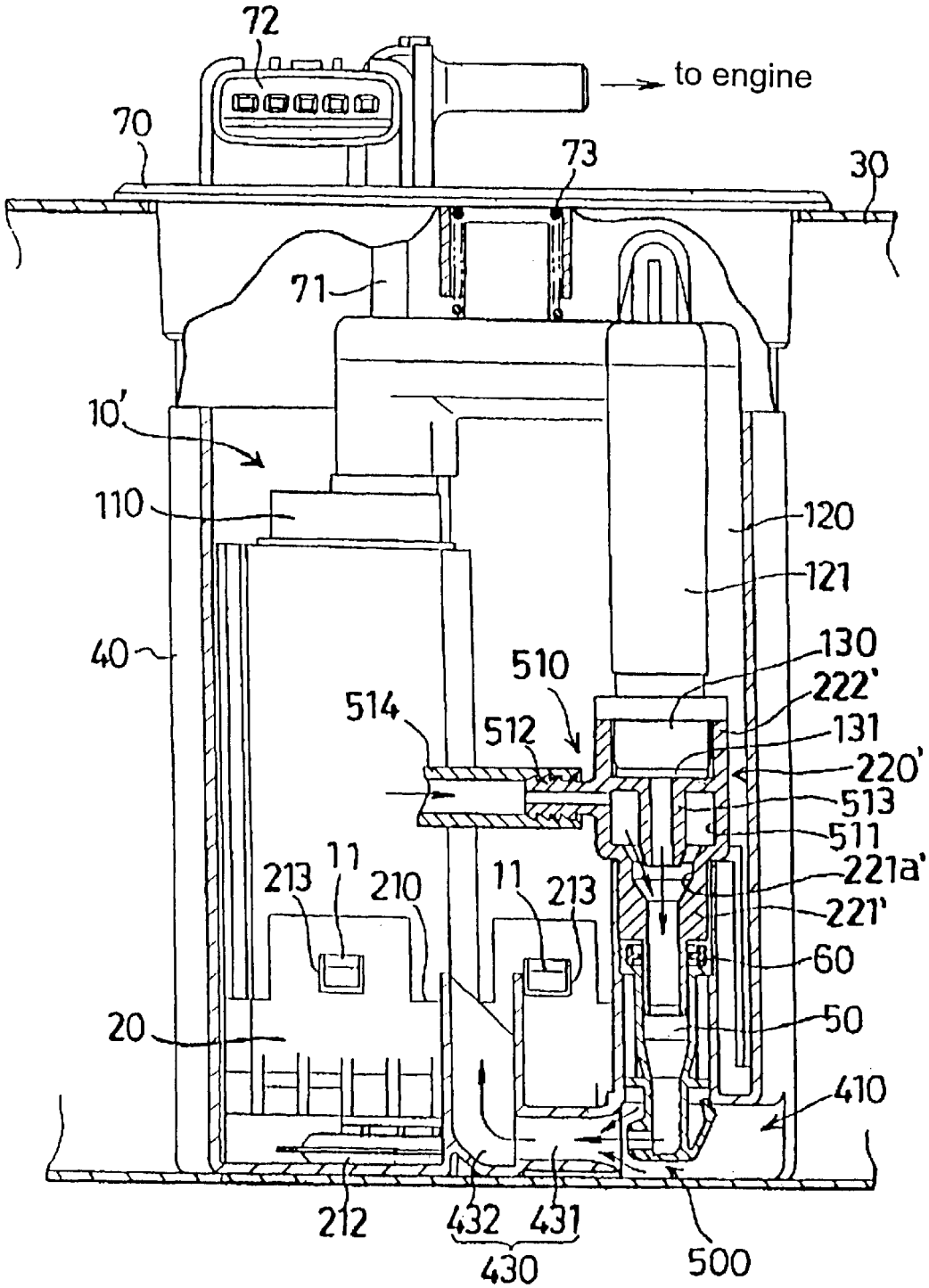
FIG. 9 is a side sectional view of a modified example of the fuel supply module according to the present invention.

FIG. 9 shows a modified example of the fuel supply module according to the present invention. A fuel supply module 10' shown here is provided for supplying a fuel to an automobile engine as in the fuel supply module described above, and the fuel supply module 10' is different from the aforementioned embodiment in that a second jet pump 510 is formed in a jet pump supply passage 220' of a supporting bracket 20.

Namely, in the fuel supply module 10' of the modified example, the second jet pump 510 is disposed at an upper end portion of a passage main body 221' extending in a vertical direction, and a regulator accommodating section 222' is disposed at an upper end portion of the second jet pump 510.

The second jet pump 510 includes a negative pressure chamber or vacuum chamber 511, a second fuel suction passage 512, and a fuel injection passage 513. The negative pressure chamber 511 has a column shape with a diameter substantially larger than that of a center hole 221*a'* of the passage main body 221', and communicates with the center hole 221*a'* of the passage main body 221'. An upper end portion of the center hole 221*a'* of the passage main body 221', which communicates with the negative pressure chamber 511, has a funnel shape with an inner diameter increasing gradually toward the upper side. The second fuel suction passage 512 extends toward outwardly from the negative pressure chamber 511, to thereby connect an inside and an outside of the negative pressure chamber 511 with each other. The fuel injection passage 513 is provided for injecting the fuel, which is relieved from the lower surface of the pressure regulator 130, to the center hole 221*a'* of the passage main body 221'. The fuel injection passage 513 is projected downwardly from a central portion of the regulator accommodating section 222', and after passing through a central portion of the negative pressure chamber 511, a distal end portion of the fuel injection passage 513 reaches the funnel-like portion in the central hole 221*a'* of the passage main body 221'. The projecting end portion of the fuel injection passage 513 is formed in a shape having an outer diameter gradually decreasing toward the lower side.

Incidentally, in the fuel supply module 10' of the modified example, the same structures as those in the aforementioned fuel supply module are designated by the same reference numerals, to thereby omit the explanations therefore.

When the driving signal is given to the fuel supply pump 110 via the connector 72 of the flange member 70, by driving the fuel supply pump 110, the fuel inside the sub tank 40 is supplied to the engine via the fuel filter 120, the pressure regulator 130, fuel delivery pipe 140 and the supply section 71 of the flange member 70. In this case, the fuel supplied to the engine is regulated at the predetermined pressure by the pressure regulator 130.

Figure 10:
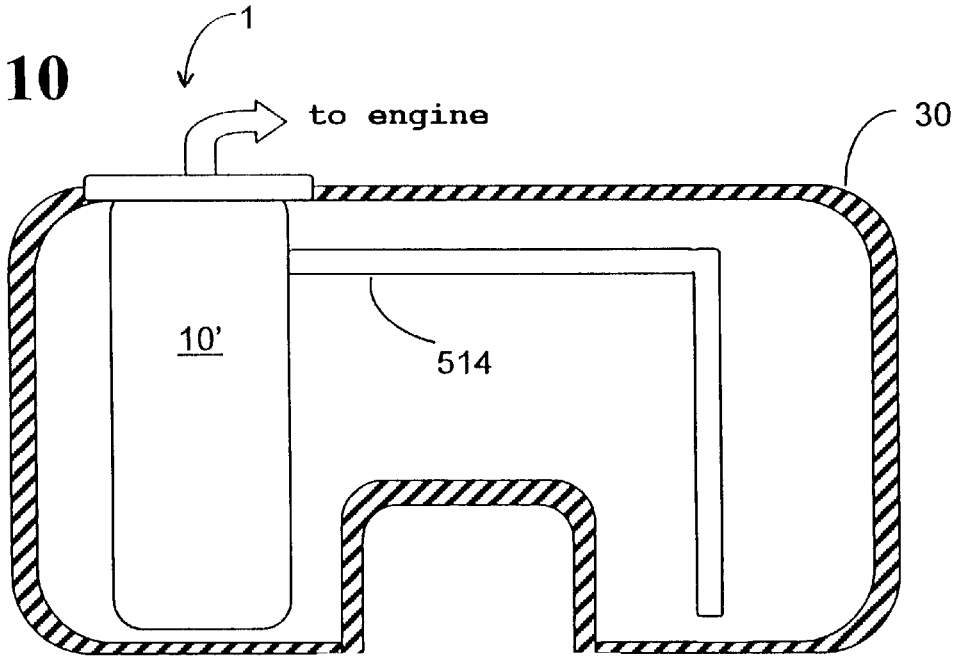
FIG. 10 is a side sectional view of an example of a fuel supply module disposed in a saddle shape fuel tank according to the present invention.

On the other hand, the fuel relieved by the pressure regulator 130 is ejected from the injection port 52 of the jet pump nozzle 50 through the jet pump supply passage 220' provided in the supporting bracket 20, and by the negative pressure that occurs when the ejected fuel passes through the fuel suction passage 430, the fuel stored in the main tank 30 is sucked together with the fuel, which is ejected from the jet pump nozzle 50, into the sub tank 40 from the periphery of the jet pump nozzle 50. Meanwhile, in the second jet pump 510, the fuel relieved from the lower surface of the pressure regulator 130 is injected from the fuel injection passage 513, and the negative pressure is generated in the negative pressure chamber 511 when the fuel passes through the center hole 221*a*' of the passage main body 221'. Accordingly, the second jet pump can be used as a fuel transfer pump using the negative pressure to transfer a fuel from other portion. For example, when a tank with divided bottoms, such as a saddle shape, is used as the main tank 30 as shown in FIG. 10, if a fuel transfer pipe line 514 is connected to the second fuel suction passage 512 in FIG. 9, a fuel stored in the divided portion can be also transferred to the sub tank 40 through the second fuel suction passage 512.

Moreover, also in the fuel supply module 10' of the modified example, regarding the assembly thereof, the fuel supply module 10' is made into one unit in advance through the supporting bracket 20 provided with the jet pump supply passage 220', and the fuel supply system extending from the fuel supply pump 110 to the jet pump nozzle 50 and the fuel supply system to the second jet pump 510 can be respectively assembled outside the sub tank 40 as in the first embodiment. At the same time, if the fuel supply module 10' made into one unit is accommodated and held in the sub tank 40, the jet pump supply passage 220' and the jet pump nozzle 50 can be connected with each other. Therefore, there is no possibility that the operations of assembling the fuel supply module 10' are cumbersome.

In the fuel supply module 10' of the modified example structured as described above, it is preferred that the first jet pump and the second jet pump are disposed in series so that fuel pressure loss can be minimized. Furthermore, according to the fuel supply module 10' of the modified example, since the second jet pump 510 is disposed within an area above the nozzle supporting cylinder body 420 in the sub tank 40, it is not necessary to provide a space exclusively for the second jet pump in the sub tank 40, resulting in being advantageous in the space efficiency.

Incidentally, in the first embodiment of the invention and the modified example described above, there is shown the fuel supply module in which the fuel relieved by the pressure regulator is supplied to the jet pump. However, the present invention can be applied to, for example, a fuel supply module in which the fuel returned as an excess fuel after being supplied to the engine is supplied to the jet pump.

Also, although the jet pump nozzle is attached from the inside of the sub tank both in the first embodiment and the modified example, the jet pump nozzle may be attached from the outside of the sub tank. Incidentally, according to the fuel supply module of the first embodiment and the modified example in which the jet pump nozzle is attached from the inside of the sub tank, the jet pump nozzle may be attached to the supporting bracket in advance, and when the fuel supply module made in one unit is accommodated and held inside the sub tank, the jet pump nozzle can be attached to the sub tank at the same time.

As described above, according to the invention, the fuel supply module includes the sub tank disposed inside the main tank storing the fuel therein, the supporting bracket attached to the inside of the sub tank in order to support the fuel supply pump inside the sub tank, and the jet pump for sucking the fuel inside the main tank from the bottom of the main tank to the inside thereof by utilizing the generated negative pressure. The fuel supply module supplies the fuel in the sub tank to the engine by driving the fuel supply pump, and supplies a part of the fuel to the jet pump to generate the negative pressure in the jet pump.

In the fuel supply module structured as described above, since the supporting bracket is provided with the jet pump supply passage, which is connected to the jet pump when the supporting bracket is attached to the sub tank, to thereby supply a part of the fuel discharged from the fuel supply pump to the jet pump, the fuel supply system extending from the fuel supply pump to a portion just before the jet pump can be assembled in advance outside the sub tank. Then, if the supporting bracket is attached to the sub tank, the fuel supply system extending from the fuel supply pump to the jet pump can be completed. Therefore, it is not required to have the operations for connecting the fuel supply system deep inside the sub tank, so that the assembling operations can be extremely facilitated.

While the invention has been explained with reference to the specific embodiments of the invention, the explanation is illustrative and the invention is limited only by the appended claims.

What is claimed is:

1. A fuel supply module for supplying a fuel to an engine, comprising:

a sub tank, a fuel supply pump disposed in the sub tank for supplying the fuel inside the sub tank to the engine, a filter connected to the fuel supply pump for filtering the fuel ejected therefrom, a pressure regulator connected to the filter for regulating pressure of the fuel ejected from the fuel supply pump, a jet pump disposed inside the sub tank for generating a negative pressure for sucking the fuel outside the sub tank into the sub tank, and a supporting bracket formed separately from the sub tank to be attached inside of the sub tank, said supporting bracket including a module accommodating section for supporting the fuel supply pump and the filter thereon, and a jet pump supply passage having a regulator accommodating section for receiving the pressure regulator therein and a nozzle inserting section to be inserted into the jet pump to partly transfer the fuel discharged from the fuel supply pump to the jet pump when the supporting bracket is attached to the sub tank so that the fuel supply pump, the filter and the pressure regulator assembled on the supporting bracket as a unit can be installed into the sub tank by inserting the unit into the sub tank.

2. A fuel supply module according to claim 1, wherein said sub tank includes a nozzle supporting body integrally formed therewith, and said jet pump includes a jet pump nozzle installed in the nozzle supporting body, said nozzle inserting section of the jet pump supply passage being connected to the jet pump nozzle when the supporting bracket is attached to the sub tank.

3. A fuel supply module according to claim 2, wherein said nozzle supporting body includes a vertical path and a lateral path joined together, said jet pump nozzle being located in the vertical path to eject the fuel to the lateral path.

4. A fuel supply module according to claim 3, wherein said jet pump supply passage, jet pump nozzle and vertical path are arranged linearly to be assembled together in one direction.

5. A fuel supply module according to claim 1, further comprising a positioning device disposed between the sub tank and the supporting bracket for regulating a position therebetween.

6. A fuel supply module according to claim 1, wherein said jet pump is provided with a sealing device for sealing between the jet pump and the jet pump supply passage.

7. A fuel supply module according to claim 1, further comprising a second jet pump provided in the jet pump supply passage.

8. A fuel supply module according to claim 7, wherein said second jet pump and the first jet pump are provided in series.

9. A fuel supply module according to claim 7, wherein said second jet pump is a fuel transfer pump.

10. A fuel supply apparatus comprising a main tank, and the fuel supply module according to claim 9 provided in the main tank.

11. A fuel supply apparatus according to claim 10, wherein said main tank has a saddle shape, and said fuel supply module is disposed in one of divided bottoms of the saddle shape main tank, said second jet pump being a fuel transfer pump for transferring a fuel from the other of the divided bottoms.

12. A fuel supply module according to claim 3, wherein said jet pump further includes an elastic engaging piece engaging the nozzle supporting body so that when the jet pump is located in the vertical path, the jet pump is immovably retained in the nozzle supporting body.

13. A fuel supply module according to claim 12, further comprising a second filter disposed under the supporting bracket and connected to the fuel supply pump for sucking the fuel therethrough.

14. A fuel supply module according to claim 13, further comprising engaging means attached to the supporting bracket, the fuel supply pump and the filter for holding the fuel supply pump and the filter to the supporting bracket, and positioning devices formed on the supporting bracket and the sub tank for positioning the supporting bracket on the sub tank when installed.

* * * * *